United States Patent [19]

Liew

[11] Patent Number: 4,896,682

[45] Date of Patent: Jan. 30, 1990

[54] CIGARETTE FILTER RODS AND CIGARETTES INCORPORATING SUCH FILTER RODS

[75] Inventor: Tow Pin Liew, Westcliff-on-Sea, England

[73] Assignee: Rothmans International Tobacco (UK) Limited, England

[21] Appl. No.: 241,663

[22] Filed: Sep. 8, 1988

[30] Foreign Application Priority Data

Sep. 17, 1987 [GB] United Kingdom ..... 8721876

[51] Int. Cl.[4] ..... A24D 3/00; A24D 3/04

[52] U.S. Cl. ..... 131/339; 131/336

[58] Field of Search ..... 131/336, 342, 337, 198.1, 131/341, 339

[56] References Cited

U.S. PATENT DOCUMENTS 4,657,032 4/1987 Dorr ..... 131/336

*Primary Examiner*—V. Millin

*Assistant Examiner*—Jennifer L. Doyle

*Attorney, Agent, or Firm*—Diller, Ramik & Wight

[57] ABSTRACT

A cigarette filter rod comprising a filter element of fibrous material, the fibres of which extend longitudinally between a first end which is for attachment to a tobacco rod and a second end, and which surrounds a longitudinally extending tube member, one end of which is closed and is located at the first end of the filter element and the open end of which extends to the second end of the element, the wall of the tube being provided with one or more radially extending apertures adjacent to its closed end to promote radial flow through the fibers of the filter element adjacent the aperture or apertures and being dimensioned so that they remain open to allow flow communication through the wall of the tube throughout the period that a cigarette provided with the rod is smoked.

18 Claims, 2 Drawing Sheets

CIGARETTE FILTER RODS AND CIGARETTES INCORPORATING SUCH FILTER RODS

BACKGROUND OF THE INVENTION

This invention relates to cigarette filter rods and cigarettes incorporating such filter rods.

It is a well known fact that the machine or humans-moked "tar" yield of the last few puffs of a conventional filter-tipped cigarette is much greater in quantity than that of the first few puffs Consequently, the "tar" in the first puffs may be perceived by the smoker to be relatively low but in the last puffs may be high enough to be perceived as "too strong".

It has long been an objective of the tobacco industries to produce a cigarette with a more even tar delivery profile. Prior art methods of evening the tar delivery profile have met with varying degrees of success. Kandel, U.S. Pat. No. 3,428,050 proposed to employ a manually adjustable filter. This filter is divided into two parts. By rotating one part of the filter, varying degrees of filtration efficiency can be achieved due to the varying degrees of registration of the high and low efficiency of the filter segments inside the two parts. The disadvantages of this design is that the construction is too complicated for modern high speed filter making machines, and the smoker has to adjust the filter constantly in order to achieve the even tar delivery profile. Browne, et al (Celanese Corp.), U.S. Pat. No. 4,460,001 and U.S. Pat. No. 4,469,112 suggested the use of a compound filter that contains a perforated barrier disc form through which the whole of the smoke passes to a cellulose acetate filter segment. The filtration efficiency of this filter increases as the smoking process proceeds. However, the pressure drop also correspondingly increases to an unacceptable level when enough tar is accumulated on the downstream of the passageways to be effective. Furthermore, this filter is very difficult to make in a modern filter making machine. Norman (Ligett & Myers), U.S. Pat. No. 3,860,011 suggested the use of a hollow tube axially along the centre of the whole filter length in order to allow a portion of the unfiltered smoke to enter into smoker's mouth at high speed. Later, in another patent, U.S. Pat. No. 4,109,666, he suggested to use the same hollow tube configuration, but of shorter tube length, not extending as far as the smoker's mouth, to avoid hot smoke reaching the smoker. The disadvantage of this design is that there is no influence on the tar delivery profile over the whole smoking period, i.e. the tar delivery increases as smoking proceeds. Stewart (Philip Morris), E.P. Patent No. 0 077 123 suggested a fusable tube placed axially at the centre of the filter and the tobacco rod. The tube does not extend the whole length of the cigarette rod, but it is about 5–10 mm short at both ends. In later puffs, the tube fuses and blocks. The design is not practical as it is very difficult to manufacture such filter in a modern filter making machine. GB Patent Specification No. 2 077 570 shows a construction in FIG. 15 comprising a tube which has perforations but the size of the perforations is such that they become clogged after the initial puffs so that the smoke all passes through the outer filter material. Similarly, in the construction described in FIG. 7 in U.S. Pat. No. 3,910,288, essentially all of the smoke passes directly through the outer main filter section once the pathway formed by a channel having an orifice becomes plugged due to the accumulation of "tar" in the area of the filter element adjacent to the orifice.

SUMMARY OF THE INVENTION

It is the objective of the present invention to provide a cigarette with a more even puff-by-puff "tar" delivery profile by the use of a special cigarette filter.

According to the present invention, a cigarette filter comprises a filter element of fibrous material, the fibres of which extend longitudinally between a first end which is for attachment to a tobacco rod and a second end, and which surrounds a longitudinally extending tube member, one end of which is closed and is located at the first end of the filter element and the open end of which extends to the second end of the element, the wall of the tube being provided with one or more radially extending apertures adjacent to its closed end to promote radial flow through the fibres of the filter element adjacent the aperture or apertures and being dimensioned so that they remain open to allow flow communication through the wall of the tube throughout the period that a cigarette provided with the rod is smoked.

The fibrous materials can be cellulose acetate tow, polypropylene tow, or any of the other known kinds of fibrous filtration material. The commonly made cigarette filters are made of tows which are polymeric fibres such as cellulose acetate, polypropylene, etc. These fibres are predominantly parallel to each other along the axial axis of a filter rod. The orientation of the fibres is therefore predominantly parallel to the flow direction of the smoke. As is well known in the art, the filtration efficiency of the fibres arranged in this way is not as efficient as in the case when the fibres are arranged to be transverse to the direction of the smoke.

When a filter as set forth is in abutment with the tobacco rod to form a filter-tipped cigarette and the cigarette is smoked, smoke enters the filter and travels inside the fibrous filter material until it reaches the location where there are apertures in the tube. The smoke now splits into two streams. One stream continues to flow inside the fibrous filter material and the other stream flows into the tube through the aperture or apertures. As the smoke stream which is diverted into the tube has only been flowing through a short length of the fibrous material, the smoke has therefore not been filtered as extensively as the other smoke stream. The "tar" concentration of the smoke stream flowing out from the tube in the first puff is therefore higher than that flowing out from the main filter body.

As the stream of smoke is being diverted into the tube through the aperture, the flow direction of the smoke has changed from being parallel to the fibres to being at an angle. The radial component of the flow has therefore greatly increased. In such flow condition, the fibres in the flow-path of this smoke are therefore transverse to the direction of the flow. Furthermore, both the velocity and momentum of the smoke particles are greatly increased as they converge to flow through the narrow apertures. The combined effects of the increased radial component of the flow and the increased particle momentum have consequently greatly increased the filtration efficiency of the fibres in the vicinity of the aperture.

The smoke particles will deposit and accumulate partially on the aperture and partially on the fibrous material around the aperture. Surprisingly it has been found that the size of the aperture and its location on the tube wall can be chosen so that the aperture or apertures will not be completely blocked by the accumulated smoke particles. Furthermore, the size of the apertures and their locations can be so chosen that the accumulation of the smoke particles on the fibres around the apertures will lead to an increase in the filtration efficiency of these fibres to an extent related to the quantity of smoke which has passed through the aperture. The smoke stream inside the tube is therefore being filtered less efficiently at the initial smoking period, but it is being filtered more and more efficiently due to this gradual increase in filtration efficiency as the smoking process proceeds. The "tar" concentration of the last few puffs is therefore very much reduced. Consequently, a cigarette fitted with this filter has a much more even and satisfying "tar" delivery profile than a conventional filter-tipped cigarette.

The invention also includes a filter rod as set forth above in combination with a tobacco rod to form a filter-tipped cigarette.

The invention can be performed in many ways and some embodiments will now be described by way of example and with reference to the accompanying drawings in which:

DESCRIPTION OF THE PREFERRED EMBODIMENTS

Figure 1:
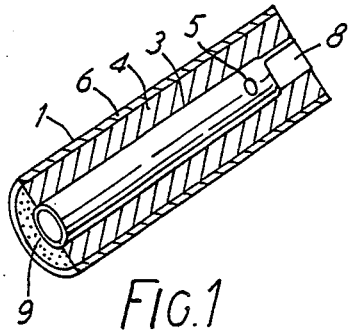
FIG. 1 is a part cross-sectional isometric view of a cigarette filter rod according to the present invention.

As shown in FIG. 1 a cigarette filter rod 1 comprises a plug wrap 6, fibrous material 4 and a tube 3 placed longitudinally along the length of the filter. One end of the tube 3 is closed by being crimped as indicated by reference numeral 8 and the other open end of the tube is indicated by reference numeral 9. A pair of opposed apertures 5 are provided in the wall of the tube adjacent the closed end 8.

Figure 2:
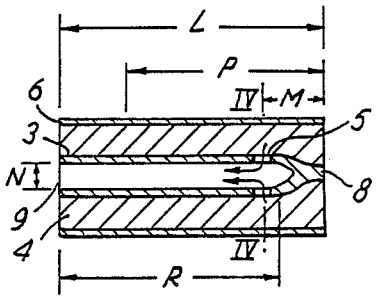
FIG. 2 is a cross-sectional view of the cigarette filter shown in FIG. 1.
Figure 5:
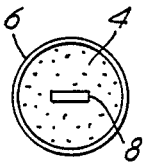
FIG. 5 is an end view of the filter shown in FIG. 1 showing the closed end of the tube.

FIG. 2 shows the cross-sectional view of the filter shown in FIG. 1. The various dimensions of the tube are shown in FIG. 2, the tube having an internal diameter N of between 1 mm and 4 mm, preferably 2 mm. The apertures 5 may be circular or any other convenient shape. The total opening area of these apertures is between 1 sq. mm and 10 sq. mm, preferably between 1 sq. mm and 4 sq. mm and the number of apertures is between 1 and 6, preferably between 1 and 4.

Micro-perforation may be used to replace the aperture. In this case, the total open area of the micro-perforations should be similar, i.e. between 1 sq. mm and 10 sq. mm Length P represents three-quarter of the total filter rod length L. The location of the apertures should be within length P as indicated in FIG. 2, preferably between the closed end 8 and mid point of length L.

Figure 3:
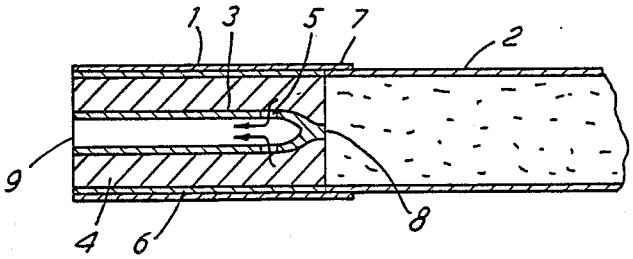
FIG. 3 is a cross-sectional view of a cigarette provided with the filter shown in FIG. 1.
Figure 4:
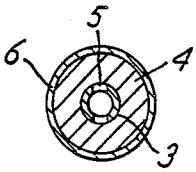
FIG. 4 is a cross-sectional view on line IV—IV of FIG. 2.

FIG. 3 shows the preferred embodiment of the present invention, in which a wrapped tobacco rod 2 is in abutment with filter 1 held in place by a non-porous tipping paper 7, a perforated tipping paper being equally suitable. Tube 3 has an internal diameter of between 1.8 mm and 2.5 mm, preferably 2 mm; and an outside diameter of about 3 mm; two apertures (numeral 5), each of between 0.6 mm and 1.3 mm diameter, are located on approximately opposite side to each other, and are located between 3 mm and 15 mm, preferably 5 mm, from the closed end 8 which is in abutment with the tobacco rod 2.

FIGS. 8–17 are the developments of tube 3 for the length R as indicated in FIG. 2. Length C represents the tube circumference; length L the total tube length; length P is two thirds of the tube length L; length H is half of length L; length M the distance between the closed end 8 and the nearest aperture on the tube wall and length B is the region where the tube is crimped to close it.

Figures 8, 9, 10, 11, 12, 13, 14, 15, 16, 17:
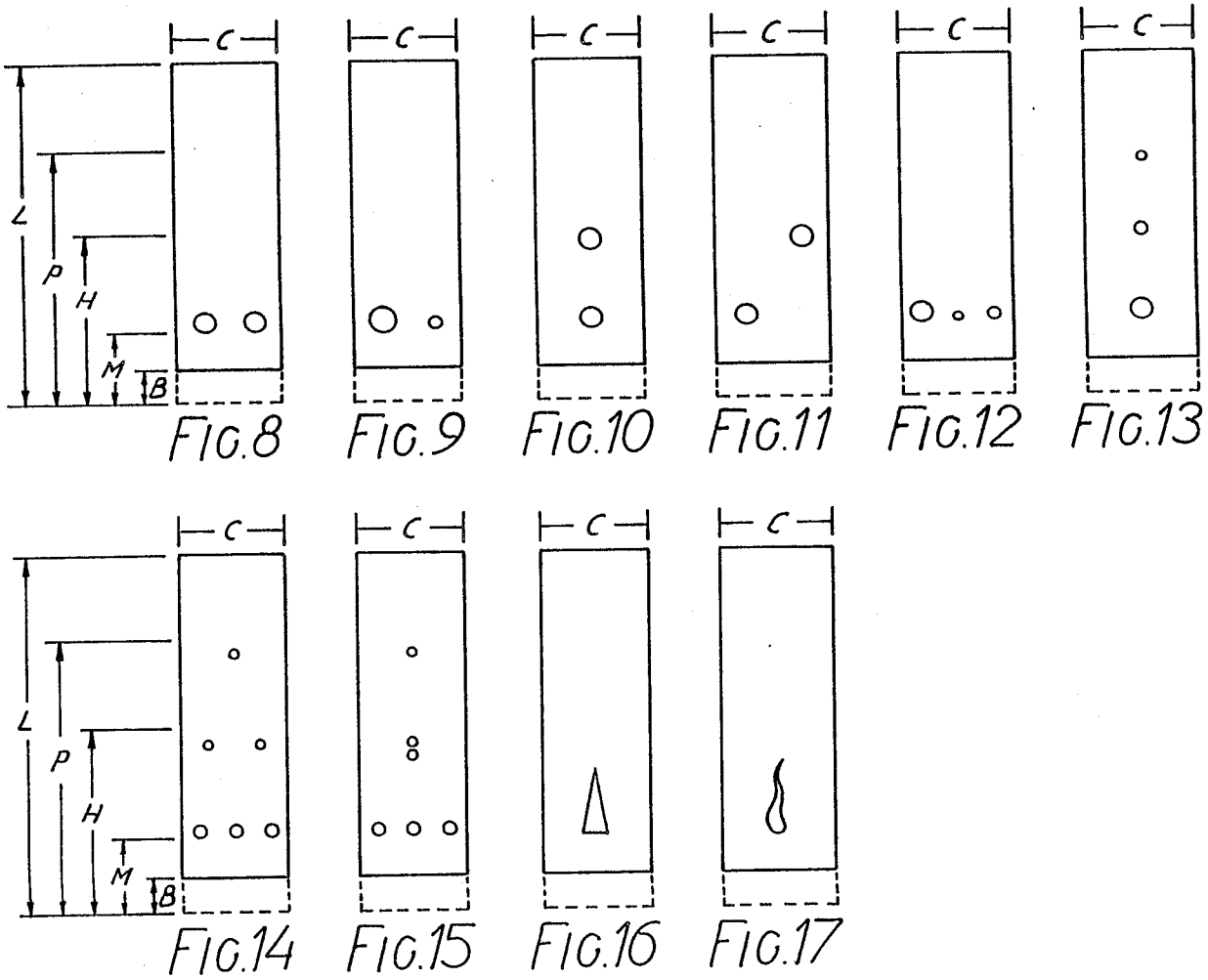
FIG. 8 is the development of the inner tube for the length R as indicated in FIG. 2.
FIGS. 9–17 are the developments of the inner tube for the length R as indicated in FIG. 2, showing various effective ways of employing aperture sizes and their locations.

FIG. 8 shows the development of tube 3 shown in FIG. 1. The two apertures are preferably equal in size and at the same distance M from the closed end 8. However, it is equally effective when the apertures are not the same size as shown in FIG. 9. Furthermore, it is also equally effective when the two apertures are not at the same distance from the closed end 8 as shown in FIGS. 10 and 11.

A range of aperture sizes can also be effectively employed. The apertures may be arranged in rows as indicated in FIG. 12. Preferably, the larger apertures should be nearer to the closed end as indicated in FIGS. 13, 14, and 15.

FIGS. 16 and 17 show two more effective ways of employing apertures of irregular shape and their preferred relative position with the closed end 8, that is, the ends with larger opening are placed towards the closed end 8.

Figure 6:
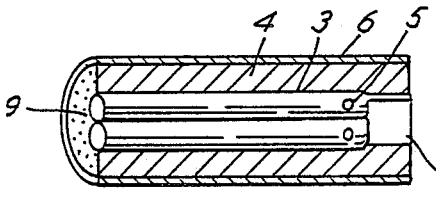
FIG. 6 is a part cross-sectional view of another embodiment of the present invention.
Figure 7:
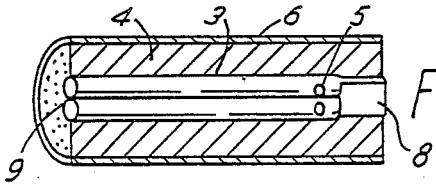
FIG. 7 is a part cross-sectional view of yet another embodiment of the present invention.

The number of tubes employed in the present invention is not restricted to only one tube. FIGS. 6 and 7 show two other effective ways of incorporating the tubes inside the filter. FIG. 6 shows the use of two circular tubes and FIG. 7 shows the use of two tubes of irregular cross-sections, the same reference numerals are used to indicate similar parts.

Figure 18:
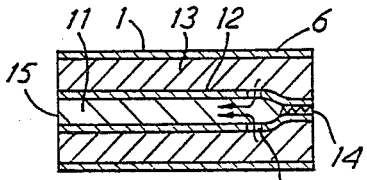
FIG. 18 is a cross-sectional view of yet another embodiment of the present invention; and, FIG. 19 is a cross-sectional view of yet another embodiment of the present invention.

FIG. 18 shows another embodiment of the present invention in which the tube 3 described previously is replaced by an impervious film tube 12 filled with a column of fibrous material 11. As in the case of tube 3, tube 12 contains aperture 5, closed end 14 and open end 15. Aperture 5 is in flow communication between fibrous material 13 and fibrous material 11. Preferably, the fibrous material 11 is less densely packed than the fibrous material 13. Furthermore, the fibre diameter should be as large as feasible. For example, a commonly available cellulose acetate tow of between 5 to 15 denier per filament (dpf), 10,000 to 50,000 total denier (T.D.) will be suitable. Material 13 should be a filtration material of high filtration efficiency. Preferably, material 13 will be the commonly used cellulose acetate tow such as the tow of about 1.5 dpf, 38,000 T.D.

When a cigarette fitted with this filter is smoked, the smoke enters the filter rod where the closed end 14 is located. The smoke initially flows through material 13. When it reaches the vicinity of aperture 5, the smoke splits into two streams; one stream of smoke continues to flow through material 13; the other stream flows through the aperture 5 and into material 11. Both streams flow out of the filter rod at the filter end where the open end 15 is located. The embodiment has an additional advantage to that shown in FIGS. 1–7. The main advantage is that material 11 in the vicinity of aperture 5 provides an additional means for the smoke particle to be captured by the mechanism of impaction as the smoke flows from aperture 5 into material 11. In fact, material 11 not only provides a filtration medium inside tube 12, it also provides an impacting surface for the smoke particles in the vicinity of aperture 5. It is well known that the velocity and momentum of the smoke particles will greatly increase when they flow through a narrow and restricted passage such as aperture 5. These conditions favour the capture of smoke particles by impaction on the fibres of material 11 which are transverse to the flow direction of the smoke in the vicinity of aperture 5. The captured smoke particles will gradually build up inside material 11 in the vicinity of aperture 5. This build-up will further improve the capture efficiency as the void volume there is reduced to a certain extent. The function of material 11 in the vicinity of aperture 5 has clearly enhanced the overall aim of a gradual increase in efficiency of the whole cigarette filter. Due to the novel idea of choosing the material 11 as a fibrous material of low packing density, i.e. of large void volume, and/or fibres of large diameter, the build-up of captured smoke particles will never be sufficient to clog up the flow passage between aperture 5 and open end 15 during the smoking period. The danger of greatly increased flow resistance in such flow passage is therefore avoided.

This filter rod can be made by modifying a dual density filter rod for example of the kind shown in U.S. Pat. Nos. 4,022,222 and 4,046,063, the tube is apertured and crimped to form a closed end 14 before it is formed into the dual density filter rod. The arrangements of apertures shown in FIGS. 8–17 are also applicable to tube 12. Flow communication at the closed end 14 is prevented either by the combination of mechanical crimping and heat treatments, or by any other suitable treatment such as the application of sufficient glue material or other filler material at this closed end location.

In all the above embodiments the tube or film tube may be made from any suitable impervious material such as paper, cardboard, polyethylene, polypropylene, nylon, cellulose acetate or other natural or synthetic polymeric material.

Figure 19:
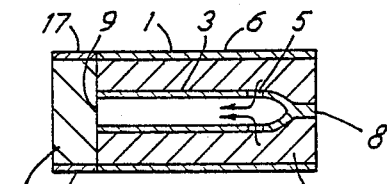

FIG. 19 shows another embodiment of the present invention in which the filter rod consists of dual filter rods, i.e. filter rod 1 and filter rod 17, in abutment to each other. Filter rod 1 is the same as described in FIGS. 1, 2, 6, 7, or 18. Filter rod 17 consists of plug wrap 6 and fibrous material 18. Material 18 may be the same as material 4 used in filter rod 1 but, preferably, material 18 is of lower density and/or lower filtration efficiency. The lengths of filter rods 1 and 17 may be the same but, preferably, filter rod 17 is shorter than filter rod 1.

The filter is assembled in a modern filter making machine, for example one which produces rods containing, say, six cigarette filter elements. A continuous length of the tubing is crimped at regular intervals by commonly used techniques such as the use of a combination of heat and pressure, with or without the inclusion of additives such as glue. The crimped position on the tube represents the closed end 8 position as illustrated in FIG. 1. The desired number of apertures are introduced in the tube wall either before, after or during the crimping process by commonly used techniques such as mechanical drilling, mechanical punching or laser evaporation. The crimped and apertured tube is introduced into the tow of fibrous material at a location prior to the garniture of the filter making machine. The continuous rod containing the tube within the tow is cut at appropriate regular intervals, either at the mid-point of a crimped portion or at the mid-point between two crimped portions of the tube, to form filter rods of the required length and required number of filter elements. If appropriate, the tube may be produced by conventional means, such as a melt extrusion process, immediately prior to the crimping operation.

EXAMPLES

Table 1 shows the comparison of puff-by-puff "tar" yields obtained from conventional filter-tipped cigarettes and cigarettes fitted with the present invention. The "tar" yield profiles of the five samples are clearly much more even in terms of "tar" delivery than those of the three conventional filter-tipped cigarettes.

TABLE 1

COMPARISON OF PUFF-BY-PUFF "TAR" YIELDS

| | TAR PER PUFF (mg) | | | | | | | |
|---|---|---|---|---|---|---|---|---|
| | CONTROL CIGARETTES | | | CIGARETTES FITTED WITH EXPERIMENTAL FILTERS | | | | |
| PUFF NO. | (1) CONTROL NO. 1 (9) | (2) CONTROL NO. 2 (10) | (3) CONTROL NO. 3 (11) | (4) SAMPLE NO. 1 (12) | (5) SAMPLE NO. 2 (13) | (6) SAMPLE NO. 3 (14) | (7) SAMPLE NO. 4 (15) | (8) SAMPLE NO. 5 (16) |
| 1 | 0.5 | 0.8 | 0.53 | 0.6 | 0.7 | 0.6 | 0.49 | 0.39 |
| 2 | 0.9 | 1.2 | 0.62 | 0.7 | 0.8 | 0.8 | 0.59 | 0.35 |
| 3 | 1.1 | 1.5 | 0.70 | 1.0 | 0.9 | 0.9 | 0.73 | 0.43 |
| 4 | 1.3 | 1.7 | 0.78 | 1.1 | 1.0 | 1.0 | 0.76 | 0.49 |
| 5 | 1.6 | 2.0 | 0.79 | 1.2 | 1.1 | 1.1 | 0.77 | 0.45 |
| 6 | 1.6 | 2.3 | 0.87 | 1.5 | 1.2 | 1.2 | 0.91 | 0.54 |
| 7 | 2.1 | 2.5 | 0.99 | 1.6 | 1.4 | 1.4 | 0.94 | 0.73 |
| 8 | 2.4 | 2.9 | 1.05 | 2.2 | 1.6 | 1.7 | 1.01 | 0.75 |
| 9 | 3.4 | 4.0 | 1.14 | 2.3 | 2.2 | 1.8 | 1.16 | 0.83 |

TABLE 1-continued

| COMPARISON OF PUFF-BY-PUFF "TAR" YIELDS | | | | | | | | |
|---|---|---|---|---|---|---|---|---|
| | TAR PER PUFF (mg) | | | | | | | |
| | CONTROL CIGARETTES | | | CIGARETTES FITTED WITH EXPERIMENTAL FILTERS | | | | |
| PUFF NO. | (1) CONTROL NO. 1 (9) | (2) CONTROL NO. 2 (10) | (3) CONTROL NO. 3 (11) | (4) SAMPLE NO. 1 (12) | (5) SAMPLE NO. 2 (13) | (6) SAMPLE NO. 3 (14) | (7) SAMPLE NO. 4 (15) | (8) SAMPLE NO. 5 (16) |
| 10 | — | — | 1.28 | — | — | — | 1.14 | 0.88 |

NOTES:
(1) Conventional filter-tipped cigarette, commercial brand. Conventional cellulose acetate filter is used.
(2) Conventional filter-tipped cigarette, commercial brand. Conventional cellulose acetate filter is used.
(3) Conventional filter-tipped cigarette. Conventional cellulose acetate filter is used.
(4) The configuration of the filter used is as illustrated in FIG. 9. One of the apertures is 1.2 mm diameter and the other 1.0 mm diameter.
(5) The configuration of the filter used is as illustrated in FIG. 8. The diameter of both apertures is 1.0 mm.
(6) The configuration of the filter used is as illustrated in FIG. 10. The diameter of both apertures is 1.0 mm.
(7) The configuration of the filter used is as illustrated in FIG. 8. The tube has an I.D. of 1.8 mm, O.D. of 2.2 mm. The apertures are 1.0 mm diameter situated 7 mm from the filter end.
(8) The configuration of the filter used is as illustrated in FIG. 18. The tube wall is cellulose acetate film. The diameter of the core rod is 5.2 mm. The apertures are 1.0 mm diameter situated 6 mm from the filter end.
(9)–(10) and (12)–(14) The results are the weight of particulate matter including water and nicotine.
(11), (15) and (16) The results are the weight of particulate matter without water and nicotine.

I claim:

1. A cigarette filter rod comprising a filter element having an outer wall which surrounds a longitudinally extending tube member to provide an annular space therebetween, said annular space containing fibrous material, the fibrous material having fibers which extend longitudinally between a first end of the filter element which is adapted for attachment to a tobacco rod and a second end thereof, one end of said tube member being closed and located at the first end of the filter element and the other end of which is open and extends to the second end of the filter element, the wall of the tube member being provided with at least one radially extending aperture adjacent to said closed end and opening into said annular space to promote radial flow through the fibers of the filter element adjacent said at least one aperture, and said at least one aperture being dimensioned so that it remains open to allow flow communication through the wall of the tube member into said annular space throughout the period that a cigarette provided with the tobacco rod is smoked.

2. A cigarette filter rod as claimed in claim 1 in which the interior of said tube member is empty.

3. A cigarette filter rod as claimed in claim 1 in which the interior of said tube member is filled with a column of filter material.

4. A cigarette filter rod as claimed in claim 3 in which the packing density of the filter material in the tube member is different to the packing density of the fibrous filter material in contact with its outer wall.

5. A cigarette filter rod as claimed in claim 3 in which the filter material in the tube member has a lower filtration efficiency than the filtration efficiency of the fibrous filter material in contact with the outer tube wall.

6. A cigarette filter rod as claimed in claim 4 in which the tube member is formed by an impervious film.

7. A cigarette filter rod as claimed in claim 1 in which the tube member has between 1 to 6 apertures in its outer wall.

8. A cigarette filter rod as claimed in claim 7 in which the apertures are arranged in a tapering pattern from the closed end of the tube member.

9. A cigarette filter rod as claimed in claim 1 in which the aperture or apertures in the wall of the tube member have a total opening area of 1 to 10 sq. mm.

10. A cigarette filter rod as claimed in claim 1 in which the aperture or apertures are located between 3 mm and two thirds of the total tube member length from the closed end of the tube.

11. A cigarette filter rod as claimed in claim 1 in which two or more substantially parallel tube members are included.

12. A cigarette filter rod as claimed in claim 11 in which the total number of apertures in the tube members walls is between 1 to 6.

13. A cigarette filter rod as claimed in claim 11 in which the total area of all the apertures in all the tube members walls is 1 to 10 sq mm.

14. A cigarette filter rod as claimed in claim 1 in which said tube members have a total internall cross-sectional area of not more than half the cross-sectional area of the filter rod.

15. A cigarette filter rod as claimed in claim 1 including a further length of abutting filter material at one end to provide dual rod segments.

16. A cigarette filter rod as claimed in claim 15 in which the further length of abutting filter material is of lower density and/or lower filtration efficiency than that used in the remainder of the rod.

17. A cigarette filter rod as claimed in claim 1 in combination with a tobacco rod to form a filter-tipped cigarette.

18. A cigarette filter rod as claimed in claim 12 in which the area of all the apertures in all the tube members walls is 1 to 10 sq mm.

* * * * *